US009254549B2

(12) United States Patent
Sakai et al.

(10) Patent No.: US 9,254,549 B2
(45) Date of Patent: Feb. 9, 2016

(54) GRINDING MACHINE

(71) Applicant: JTEKT Corporation, Osaka (JP)

(72) Inventors: Toshiki Sakai, Kariya (JP); Satoshi Okubo, Anjo (JP); Shinji Soma, Kashiwara (JP); Naoto Ono, Anjo (JP)

(73) Assignee: JTEKT Corporation, Osaka-shi (JP)

( * ) Notice: Subject to any disclaimer, the term of this patent is extended or adjusted under 35 U.S.C. 154(b) by 1 day.

(21) Appl. No.: 14/263,032

(22) Filed: Apr. 28, 2014

(65) Prior Publication Data

US 2014/0335769 A1 Nov. 13, 2014

(30) Foreign Application Priority Data

May 7, 2013 (JP) ..... 2013-097667
May 7, 2013 (JP) ..... 2013-097668

(51) Int. Cl.
*B24B 53/00* (2006.01)
*B24B 53/06* (2006.01)
*B24B 53/14* (2006.01)

(52) U.S. Cl.
CPC ..... *B24B 53/062* (2013.01); *B24B 53/005* (2013.01); *B24B 53/14* (2013.01)

(58) Field of Classification Search
CPC ..... B24B 53/017; B24B 53/12; B24B 53/00; B24B 53/02; B24B 53/14
USPC ..... 451/72, 56, 443
See application file for complete search history.

(56) References Cited

U.S. PATENT DOCUMENTS 4,073,281 A * 2/1978 Asaeda et al. ..... 125/11.03
4,266,374 A * 5/1981 Asano et al. ..... 451/21
4,607,607 A 8/1986 Janutta et al.
4,683,679 A * 8/1987 Salmon ..... 451/72
5,119,599 A 6/1992 Klipper et al.
5,683,290 A * 11/1997 Kanda et al. ..... 451/72
5,711,696 A * 1/1998 Maeda et al. ..... 451/5
6,113,474 A * 9/2000 Shih et al. ..... 451/72
6,123,607 A * 9/2000 Ravkin et al. ..... 451/56
6,217,420 B1 * 4/2001 Stocker et al. ..... 451/43
6,217,422 B1 * 4/2001 Franca et al. ..... 451/56
6,248,003 B1 * 6/2001 Hoshiya et al. ..... 451/56

(Continued)

FOREIGN PATENT DOCUMENTS

GB 2 146 927 A 5/1985
JP 5-269665 10/1993

(Continued)

OTHER PUBLICATIONS

The Extended European Search Report issued Oct. 2, 2014, in Application No. / Patent No. 14166958.0-1702.

*Primary Examiner* — George Nguyen

(74) *Attorney, Agent, or Firm* — Oblon, McClelland, Maier & Neustadt, L.L.P.

(57) ABSTRACT

A grinding machine includes: a grinding wheel of which movement in an X direction and a Z direction is controlled and that grinds a workpiece; and a truing unit that is installed at a predetermined position and that trues a machining surface of the grinding wheel. The truing unit includes: a movable table that is installed to be movable in the X direction relative to a support member; a truer that is rotatably installed in the movable table and that trues the machining surface of the grinding wheel; and an X-direction pressing mechanism that presses the truer in the X direction along with the movable table.

8 Claims, 8 Drawing Sheets

(56) References Cited

U.S. PATENT DOCUMENTS

| | | | | |
|---|---|---|---|---|
| 6,263,605 | B1 * | 7/2001 | Vanell | 451/443 |
| 6,616,508 | B1 * | 9/2003 | Kamamura et al. | 451/8 |
| 7,096,561 | B2 * | 8/2006 | Kinpara et al. | 29/526.4 |
| 2005/0282476 | A1 * | 12/2005 | Lujan | 451/56 |
| 2009/0280726 | A1 * | 11/2009 | Kasuga et al. | 451/56 |
| 2009/0305618 | A1 * | 12/2009 | Morita et al. | 451/443 |
| 2012/0329368 | A1 * | 12/2012 | Wakazono et al. | 451/21 |

FOREIGN PATENT DOCUMENTS

| | | |
|---|---|---|
| JP | 2010-253623 | 11/2010 |
| JP | 2010-284769 | 12/2010 |

* cited by examiner

GRINDING MACHINE

INCORPORATION BY REFERENCE

The disclosure of Japanese Patent Application Nos. 2013-097667 and 2013-097668 filed on May 7, 2013 including the specification, drawings and abstract is incorporated herein by reference in its entirety.

BACKGROUND OF THE INVENTION

1. Field of the Invention

The present invention relates to a grinding machine having a truing unit.

2. Description of Related Art

A grinding machine is disclosed which grinds a workpiece while controlling movement in an X direction and a Z direction of a grinding wheel (disc-like rotary grinding wheel) and which includes a truing unit so as to true a machining surface of the grinding wheel (for example, see Japanese Patent Application Publication No. 2010-253623 (JP 2010-253623 A) and Japanese Patent Application Publication No. 2010-284769 (JP 2010-284769 A)). In the grinding machine disclosed in JP 2010-253623 A, a grinding wheel and a truer are respectively rotationally driven by independent drive units. That is, the grinding wheel is rotationally driven by a grinding wheel drive motor and the truer is rotationally driven by a truer drive motor. In order to adjust surface roughness (a degree of cutting) of the grinding wheel in truing, rotational speeds of the grinding wheel and the truer are independently controlled to change a circumferential speed ratio of the grinding wheel and the truer.

In a truing unit of the grinding machine disclosed in JP 2010-284769 A, as illustrated in FIG. 11, a truer drive motor 178 and a truer 177 that is rotationally driven about a truer shaft 176 by the truer drive motor 178 are installed in a support member, for example, a spindle housing 142 of a first spindle unit. The spindle housing 142 is provided with a contact detecting mechanism 135 including a pin-like thermal displacement detector 136 that is located on a side of the truer 177 and that detects thermal displacement of a grinding wheel shaft 131 (thermal displacement of the grinding wheel shaft 131 in the Z direction) by contact and a pin-like outer circumference detector 137 that detects an outer circumferential position of the grinding wheel 132 by contact. The thermal displacement of the grinding wheel shaft 131 and the outer circumferential position of the grinding wheel 132 are detected before truing the grinding wheel 132 by the use of the truer 177, movement in the Z direction of the grinding wheel 132 is controlled on the basis of the detected thermal displacement and the detected outer circumferential position of the grinding wheel 132, and then movement in the X direction of the grinding wheel 132 is controlled. Then, the grinding wheel 132 is trued by finely moving the grinding wheel 132 in the X direction while bringing the grinding wheel 132 into contact with the truer 177 rotating by the operation of the truer drive motor 178.

SUMMARY OF THE INVENTION

In the grinding machine, the grinding wheel drive motor and the truer drive motor are required for independently rotationally controlling the grinding wheel and the truer, and the driving of the grinding wheel drive motor and the truer drive motor has to be controlled, thereby making the structure or the control complicated.

In the grinding machine, the thermal displacement of the grinding wheel shaft 131 and the outer circumferential position of the grinding wheel 132 have to be detected in advance whenever truing the grinding wheel 132 with the truer 177, thereby extending the truing time.

The present invention provides a grinding machine that can simplify the structure of a truing unit.

The present invention also provides a grinding machine that can reduce a truing time of a grinding wheel.

A grinding wheel according to an aspect of the present invention includes: a grinding wheel of which movement in an X direction and a Z direction is controlled and that grinds a workpiece; and a truing unit that is installed at a predetermined position and that trues a machining surface of the grinding wheel. The truing unit includes a movable table that is installed to be movable in the X direction relative to a support member, a truer that is rotatably installed in the movable table and that trues the machining surface of the grinding wheel, and an X-direction pressing mechanism that presses the truer in the X direction along with the movable table.

According to the aspect, when the grinding wheel moves to the truing start position in front of the truer at the time of truing the grinding wheel, the grinding wheel moves forward in the X direction to a truing position at which the grinding wheel comes into contact with the truer. Accordingly, it is possible to true the grinding wheel. As a result, it is possible to make a drive mechanism such as a dedicated motor for rotationally driving the truer unnecessary, thereby simplifying the structure of the truing unit.

In the aspect, the movable table may be installed to be movable in the X direction relative to the support member in a state where the movable table is pressed in the X direction by the X-direction pressing mechanism, and the truer may be installed to be rotatable about an axis line in the Z direction relative to the movable table and may true the machining surface of the grinding wheel by coming into contact with the grinding wheel with a pressing force of the X-direction pressing mechanism and rotating to follow the grinding wheel.

According to this configuration, the truer is pressed against the grinding wheel with the pressing force set by the X-direction pressing mechanism and the truer rotates to follow the rotation of the grinding wheel. Accordingly, it is possible to true the grinding wheel and to make a drive mechanism such as a dedicated motor for rotationally driving the truer unnecessary, thereby simplifying the structure of the truing unit.

The grinding machine according to the aspect may further include a drive mechanism that rotationally drives the truer.

According to this configuration, at the time of truing the grinding wheel, the grinding wheel moves to the truing start position in front of the truer and the truer is rotationally driven by the drive mechanism. Here, the grinding wheel moves forward in the X direction to the truing position at which the grinding wheel comes into contact with the truer. Thereafter, the grinding wheel moves forward in the X direction to a cutting position corresponding to a set degree of cutting, whereby the grinding wheel is trued. At this time, since the truer is pressed against the grinding wheel with a pressing force set by the X-direction pressing mechanism, an excessive pressing force is not generated and thus the grinding wheel is excellently trued. Since the grinding wheel can be trued as described above, it is possible to save the labor for detecting the outer circumferential position of the grinding wheel before truing and thus to reduce the truing time of the grinding wheel by as much.

In the aspect, the X-direction pressing mechanism may be configured to adjust the pressing force of the truer against the grinding wheel.

According to this configuration, the pressing force of the truer against the grinding wheel can be adjusted by the X-direction pressing mechanism, and the rotational speed of the truer is changed by adjusting the pressing force to be larger or smaller. Accordingly, it is possible to adjust the surface roughness of the grinding wheel by changing a circumferential speed ratio of the grinding wheel and the truer. For example, when the pressing force of the truer against the grinding wheel is adjusted to be larger, the truer rotates to follow the grinding wheel substantially at the same speed as the circumferential speed of the grinding wheel and thus the circumferential speed ratio of the grinding wheel and the truer increases. Accordingly, it is possible to true the grinding wheel with high surface roughness. In contrast, when the pressing force of the truer against the grinding wheel is adjusted to be smaller, a degree of slipping between the grinding wheel and the truer increases and the circumferential speed ratio of the grinding wheel and the truer decreases. Accordingly, it is possible to true the grinding wheel with low surface roughness.

As described above, when the grinding machine provided with a drive mechanism rotationally driving the truer has the above-mentioned configuration and a degree of truing of the grinding wheel is small (minute), it is possible to excellently true the machining surface (grinding wheel surface) of the grinding wheel by setting the pressing force of the truer against the grinding wheel to be smaller by the use of the X-direction pressing mechanism. When the degree of truing of the grinding wheel is large, it is possible to true the machining surface (grinding wheel surface) of the grinding wheel for a short time by setting the pressing force of the truer against the grinding wheel to be larger by the use of the X-direction pressing mechanism.

In the aspect, the truer may be installed to be movable in the Z direction relative to the movable table.

According to this configuration, when the grinding wheel moves forward in the X direction to the truing position at which the grinding wheel comes into contact with the truer and the grinding wheel is displaced in the Z direction to correspond to the thermal displacement of the grinding wheel shaft, the truer is displaced (moves) in the Z direction relative to the movable table while coming into contact with the grinding wheel with the forward movement of the grinding wheel to the truing position. Accordingly, it is possible to save the labor for detecting the thermal displacement of the grinding wheel before truing and thus to reduce the truing time of the grinding wheel by as much.

In the aspect, the truer may be returned to a Z-direction neutral position relative to the movable table by a Z-direction return spring.

According to this configuration, since the truer is returned to the Z-direction neutral position relative to the movable table through the use of the Z-direction return spring, the truer is not located close to one end in the Z direction. Accordingly, when the grinding wheel moves forward in the X direction to the truing position at which the grinding wheel comes into contact with the truer and the grinding wheel is displaced in the Z direction to correspond to the thermal displacement of the grinding wheel shaft, the truer comes into contact with the grinding wheel without contact failure and is displaced (moves) in the Z direction with the forward movement of the grinding wheel to the truing position. As a result, it is possible to excellently true the machining surface (grinding wheel surface) of the grinding wheel without truing failure. That is, when the truer is not located at the Z-direction neutral position but is located close to one end in the Z direction, the grinding wheel may depart from the truer to cause truing failure. However, according to the aspect, this problem can be prevented.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

A mode for carrying out the present invention will be described below in conjunction with embodiments.

Figure 1:
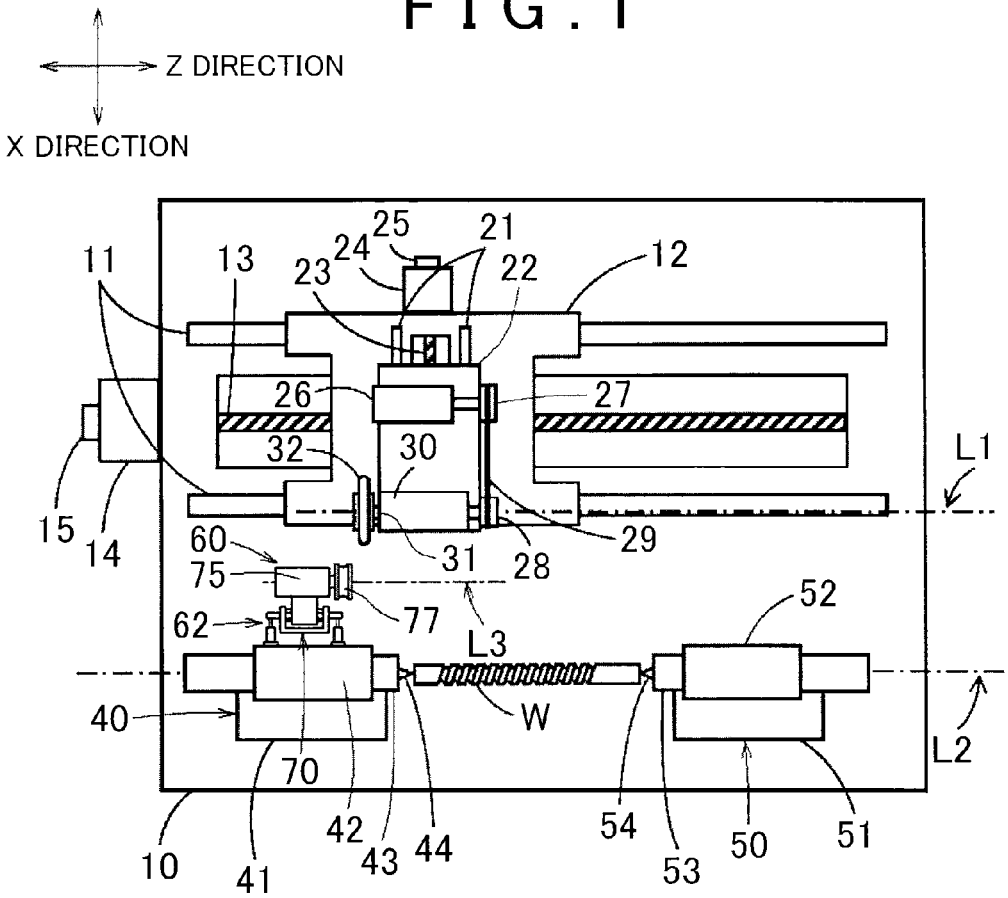
FIG. 1 is a plan view illustrating a grinding machine according to Embodiments 1 and 2 of the present invention.
Figure 2:
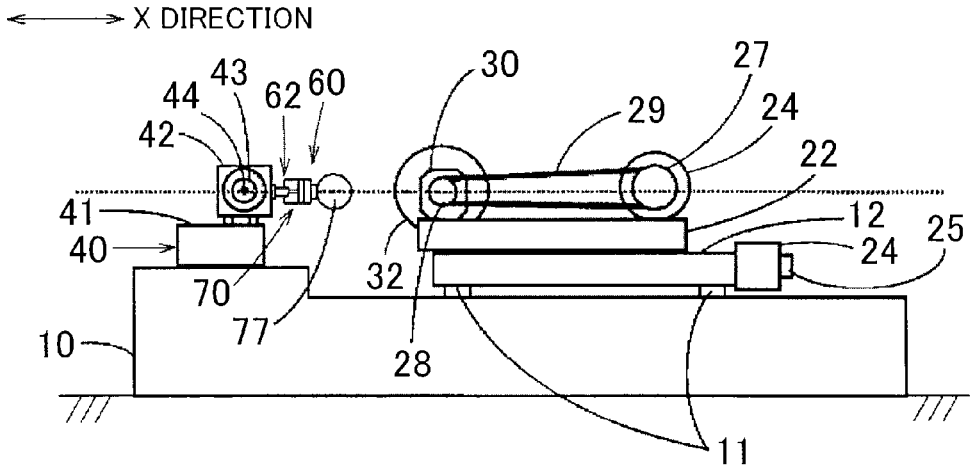
FIG. 2 is a side view illustrating the grinding machine.

A grinding machine according to Embodiment 1 of the present invention will be described below with reference to the accompanying drawings. As illustrated in FIGS. 1 and 2, in a grinding machine that grinds a workpiece W while controlling movement in an X direction and a Z direction of a grinding wheel 32, a Z-direction slide table 12 that is guided in a sliding manner by a pair of Z-direction guide rails 11 extending in the Z direction is installed substantially at the center of a base table 10 having a rectangular planar shape. The Z-direction slide table 12 is made to slide in the Z direction with the rotation of a Z-direction feed screw 13 using a Z-direction drive motor 14, of which the operation is controlled by a controller (NC controller or the like) as a drive source. The Z-direction drive motor 14 is provided with a Z-direction position detecting unit 15 such as an encoder that detects a rotation angle of an output shaft of the Z-direction drive motor 14 and sends the detection signal to the controller so as to check the position in the Z direction of the Z-direction slide table 12.

An X-direction slide table (grinding wheel slide table) 22 that is guided in a sliding manner by a pair of X-direction guide rails 21 extending in the X direction is installed on the Z-direction slide table 12. The X-direction slide table 22 is made to slide in the X direction with the rotation of an X-direction feed screw 23 using an X-direction drive motor 24, of which the operation is controlled by a controller (not illustrated) as a drive source. The X-direction drive motor 24 is provided with an X-direction position detecting unit 25 such as an encoder that detects a rotation angle of an output shaft of the X-direction drive motor 24 and sends the detection signal to the controller so as to check the position in the X direction of the X-direction slide table 22.

A grinding wheel drive motor 26 and a grinding wheel shaft holder 30 are installed on the X-direction slide table 22, and the output shaft of the grinding wheel drive motor 26 is provided with a driving pulley 27. On the other hand, the other end of a grinding wheel shaft (which is disposed on a Z-direction axis line L1 parallel to the axis line in the Z direction) 31 that is rotatably supported by the grinding wheel shaft holder 30 and of which one end is provided with a disc-like grinding wheel 32 is provided with a driven pulley 28. A belt 29 is suspended between the driving pulley 27 and the driven pulley 28, whereby the torque of the output shaft of the grinding wheel drive motor 26 is transmitted to the grinding wheel shaft 31 via the belt 29.

On the base table 10, a first spindle unit 40 and a second spindle unit 50 that maintain a rod-like workpiece W at a set position while causing the workpiece W to rotate around a central axis line in the Z direction are installed on the Z-direction axis line L2 parallel to the axis line in the Z direction. The first spindle unit 40 includes a spindle base 41 fixed onto the base table 10, a spindle housing 42 reciprocating along the Z-direction axis line L2 relative to the spindle base 41, and a spindle 43 that is supported to be rotatable around the Z-direction axis line L2 in the spindle housing 42, and an end of the spindle 43 is provided with a centering member 44 that supports the central portion of one end face of the workpiece W. The rotation of the spindle 43 is controlled up to an arbitrary angle at an arbitrary angular speed using a spindle motor (not illustrated) of which the operation is controlled by the controller as a drive source. Similarly to the first spindle unit 40, the second spindle unit 50 also includes a spindle base 51, a spindle housing 52, a spindle 53, and a centering member 54.

Figure 3:
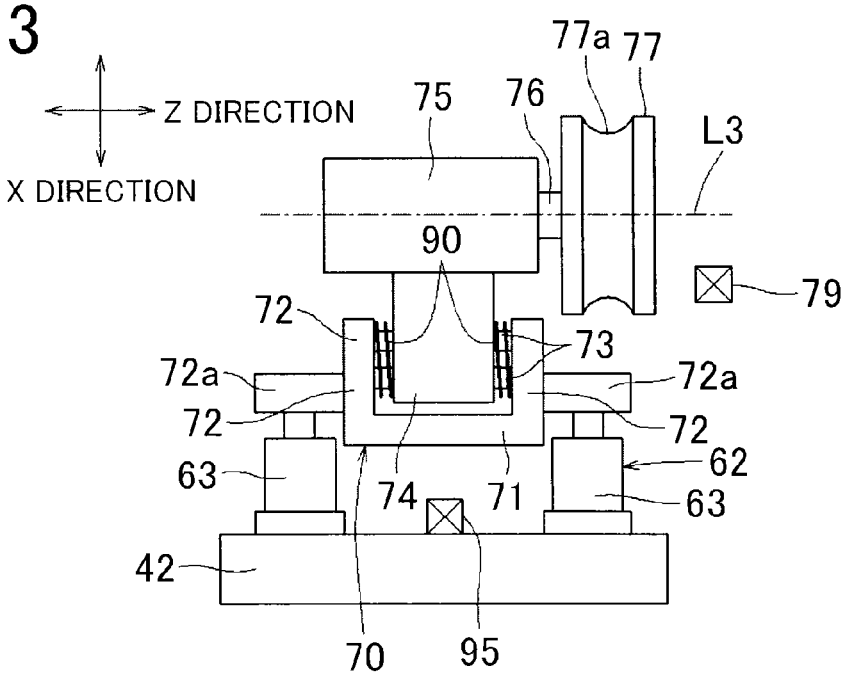
FIG. 3 is a plan view illustrating a truing unit of the grinding machine according to Embodiment 1.
Figure 4:
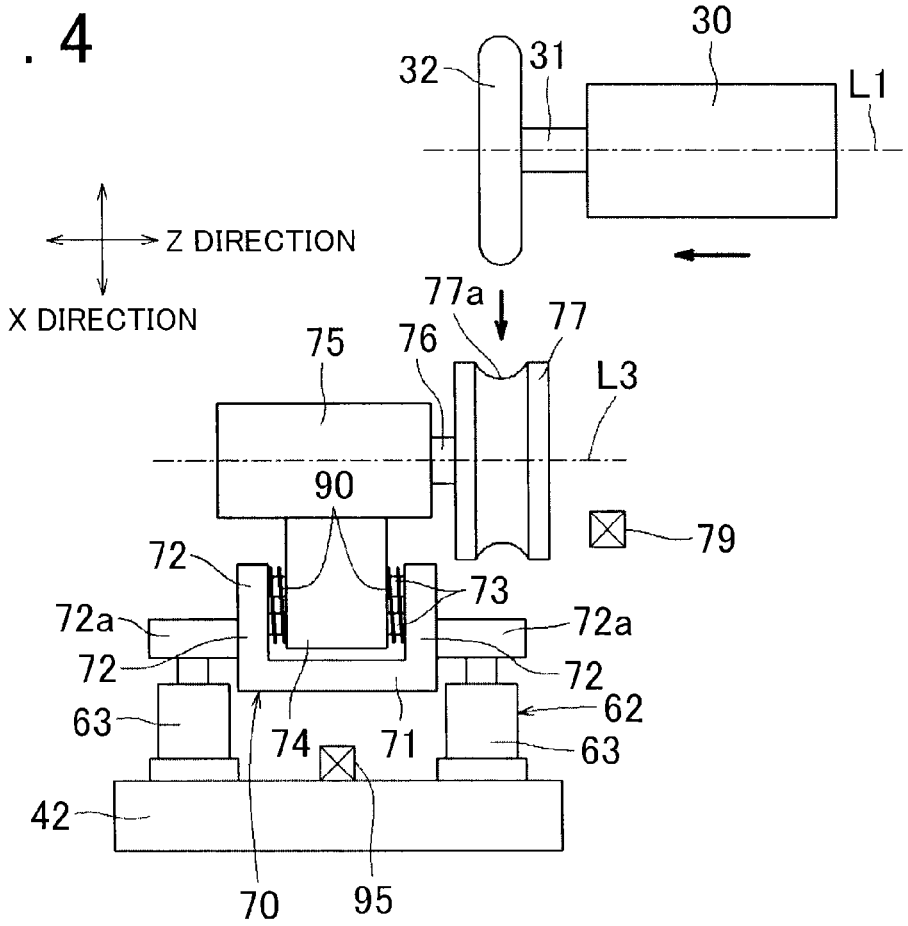
FIG. 4 is an explanatory diagram illustrating a state where a grinding wheel moves in the Z direction to a front position of a truer of the truing unit.
Figure 5:
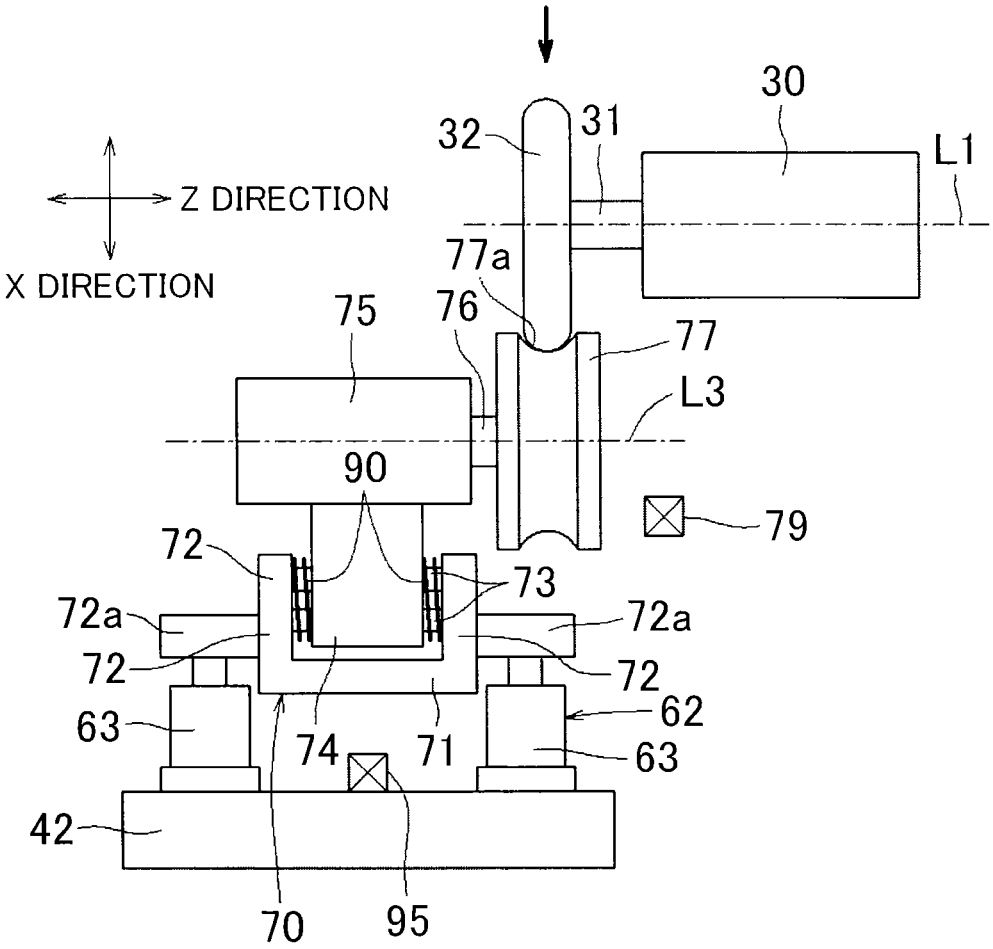
FIG. 5 is an explanatory diagram illustrating a state where the grinding wheel moves in the X direction to a truing position at which the grinding wheel comes into contact with the truer.

As illustrated in FIG. 3, the truing unit 60 includes a movable table 70 that is installed to be movable in the X direction relative to the spindle housing 42 (which corresponds to the support member in the present invention) of the first spindle unit 40 in a state where the movable table 70 is pressed in the X direction by an X-direction pressing mechanism 62 and a disc-like truer 77 that is installed to be rotatable around the Z-direction axis line L3 parallel to the axis line in the Z direction relative to the movable table 70 and that trues the machining surface of the grinding wheel 32.

In Embodiment 1, as illustrated in FIG. 3, the movable table 70 includes a Z-direction base 71 and both side wall portions 72 that protrudes at the right angle from both sides of the base 71 and has a substantially U-shape. One or more X-direction pressing cylinders 63 such as air cylinders or hydraulic cylinder as the X-direction pressing mechanism 62 are installed between extension portions 72*a* extending from both side wall portions 72 of the movable table 70 and the spindle housing 42 as the support member. The X-direction pressing cylinders 63 are connected to a fluid supply source via a pressure control valve (electromagnetic valve) which is not illustrated. The pressure control valve (electromagnetic valve) is controlled by the controller. The movable table 70 is pressed in the X direction with a desired pressing force by the X-direction pressing cylinders 63.

As illustrated in FIG. 3, plural (or one) Z-direction guide bars 73 are installed between the both side wall portions 72 of the movable table 70, and the Z-direction guide bars 73 are provided with a Z-direction slide member 74 so as to be slidable in the Z direction in a state where the rotation thereof is stopped. Z-direction returning springs 90 are respectively interposed between the both side wall portions 72 of the movable table 70 and the Z-direction slide member 74, and the Z-direction slide member 74 is installed at the Z-direction neutral position by the Z-direction return springs 90. A truer shaft holder 75 is formed as a unified body with the Z-direction slide member 74. A truer shaft 76 having a central axis line on the Z-direction axis line L3 parallel to the axis line in the Z direction is rotatably supported by the truer shaft holder 75, and a truer 77 that rotates along with the truer shaft 76 is installed at an end of the truer shaft 76. The outer circumferential surface of an end face in the axis direction of the truer 77 is formed as a concave-curved surface (or a concave arc-like surface) 77*a*. A truer rotation detecting unit 79 is installed on a side of the truer 77. An X-direction displacement detecting unit 95 that detects displacement in the X direction of the movable table 70 is installed between the movable table 70 and the spindle housing 42 as the support member.

Figure 6:
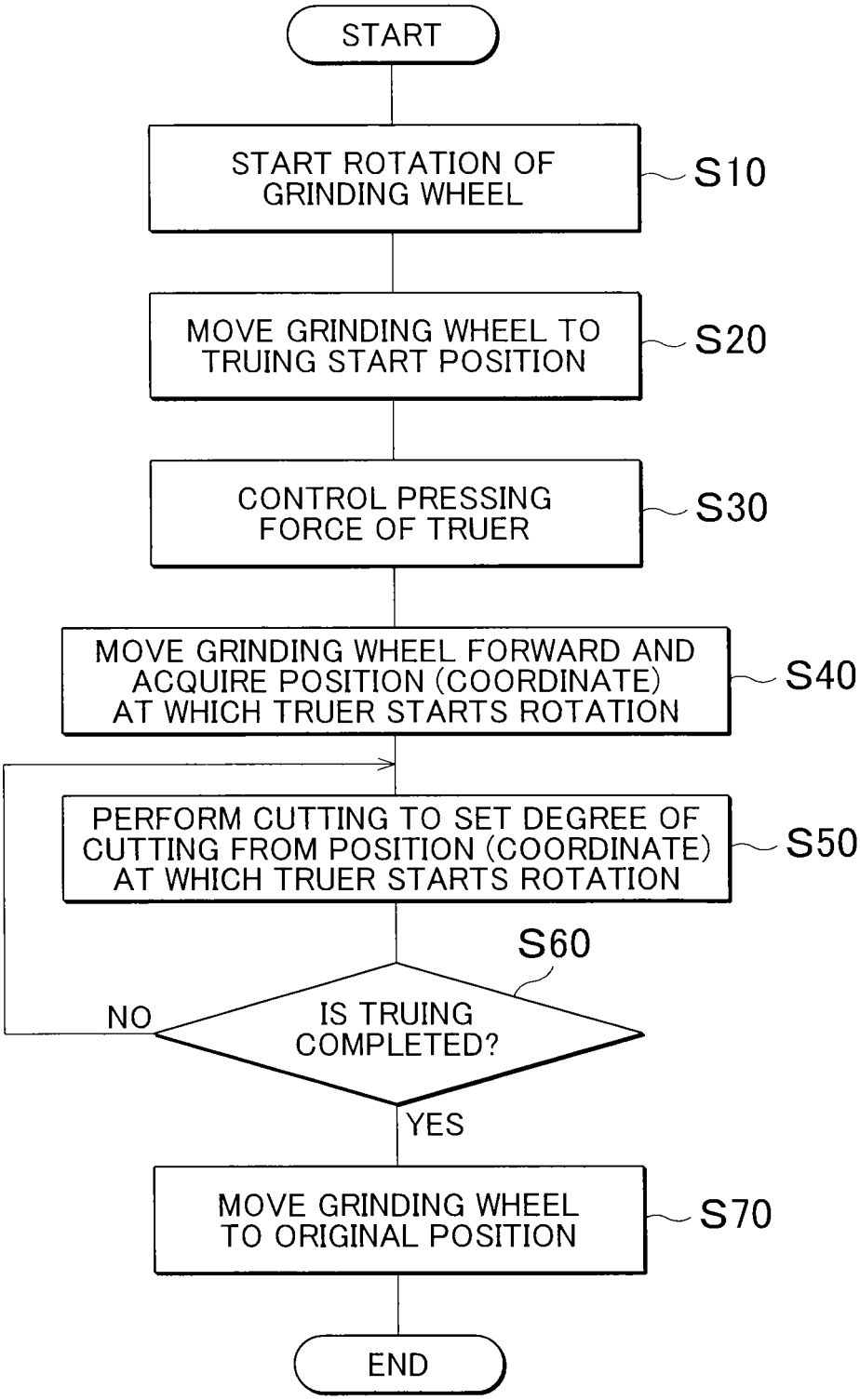
FIG. 6 is a flowchart illustrating a process flow of a truing process.

An example of a process flow which is performed by the controller will be described below with reference to the flowchart illustrated in FIG. 6. The controller performs the process flow illustrated in FIG. 6 when performing of a truing operation is instructed, when a predetermined truing timing arrives, or the like. In step S10, the controller starts the rotational driving of the grinding wheel 32 and then performs the process of step S20. The truer 77 is rotatably supported, does not have a motor or the like as a drive source, and rotates to follow the grinding wheel 32 by coming into contact with the rotating grinding wheel 32.

In step S20, the controller controls the operation of the Z-direction drive motor 14 and the X-direction drive motor 24 so that the position of the truer 77 relative to the grinding wheel 32 is located at a truing start position, and accordingly causes the position of the grinding wheel 32 relative to the truer 77 to move to a set position (truing start position). Then, the controller causes the truer 77 and the grinding wheel 32 to face each other and then performs the process of step S30.

In step S30, the controller controls the pressing force of the truer 77 and then performs the process of step S40. In Embodiment 1, the X-direction pressing cylinders 63 are used to control the pressing force of the truer 77. In this case, the pressure control valve for the X-direction pressing cylinders 63 is controlled to a desired pressing force so as to adjust the pressing force of the X-direction pressing cylinders 63. As the pressing force increases, the degree of slipping decreases and the rotational speed of the following rotation of the truer 77 increases. That is, by adjusting the pressing force of the truer 77, it is possible to adjust the rotational speed of the following rotation of the truer 77 and to change the circumferential speed ratio of the grinding wheel 32 and the truer 77, thereby adjusting the surface roughness of the grinding wheel 32 after the truing.

In step S40, the controller causes the grinding wheel 32 to move in the X direction to the truer 77, acquires the coordinate of the grinding wheel 32 when the truer 77 rotatably supported by the movable table 70 starts the rotation from a stopped state and a detection signal from the X-direction displacement detecting unit 95 disposed on the side of the truer 77, and then performs the process of step S50. The truer 77 is provided with the truer rotation detecting unit 79, and the controller can acquire a detection signal from the truer rotation detecting unit 79 and can detect the time point at which the truer 77 starts the rotation from the stopped state. This time point is a time point at which the grinding wheel 32 and the truer 77 come into contact with each other. At that time point, the controller can detect the coordinate (the X coordinate in this case) of the grinding wheel 32 on the basis of the detection signal from the X-direction position detecting unit 25 that detects the position of the X-direction slide table 22 and can detect the position in the X direction of the truer 77 on the basis of the detection signal from the X-direction displacement detecting unit 95.

In step S50, the controller performs (starts) the truing operation of cutting the grinding wheel 32 (moving in the X direction in this case) by a predetermined degree of cutting from the position (coordinate) of the grinding wheel 32 when the truer 77 starts the rotation, and then performs the process of step S60.

In step S60, the controller determines whether the truing operation is performed to a predetermined degree of cutting on the basis of the position (which is stored in step S40) in the X-direction of the truer 77 at the time of starting the truing operation (when the truer starts the rotation), the current position in the X direction of the truer 77 which is detected by the X-direction displacement detecting unit 95, the coordinate (which is stored in step S50) in the X direction of the grinding wheel 32 at the time of starting the truing operation (when the truer 77 starts the rotation), and the current coordinate in the X-direction of the grinding wheel 32 which is detected by the X-direction position detecting unit 25. When it is determined that the truing operation is performed to the predetermined degree of cutting (YES), the controller determines that the truing operation is completed and then performs the process of step S70. When it is determined that the truing operation is not performed to the predetermined degree of cutting (NO), the controller determines that the truing operation is not completed and then performs the process of step S50 again. In step S70, the controller causes the grinding wheel 32 to move relative to the truer 77, returns the grinding wheel 32 to the original position, stops the control of the pressing force of the truer 77, and ends the truing process.

As described above, in Embodiment 1, when the grinding wheel 32 moves to the truing start position in front of the truer 77 at the time of truing the grinding wheel 32, the grinding wheel 32 moves in the X direction to the truing position at which the grinding wheel 32 comes into contact with the truer 77. At this time, the truer 77 is pressed against the grinding wheel 32 with a pressing force set by the X-direction pressing cylinders 63 as the X-direction pressing mechanism 62. Accordingly, the truer 77 rotates to follow the rotation of the grinding wheel 32. As a result, since the grinding wheel 32 can be trued, the drive mechanism such as a dedicated motor for rotationally driving the truer 77 is made to be unnecessary, thereby simplifying the structure.

In Embodiment 1, the X-direction pressing cylinders 63 as the X-direction pressing mechanism 62 are configured to adjust the pressing force of the truer 77 against the grinding wheel 32. That is, the X-direction pressing cylinders 63 can adjust the pressing force of the truer 77 against the grinding wheel 32 by causing the controller to control the pressure control valve (electromagnetic valve) connected to a fluid supply source. By adjusting the pressing force to be larger or smaller, the rotational speed of the truer 77 rotating to follow the grinding wheel 32 is changed. Accordingly, by changing the circumferential speed ratio of the grinding wheel 32 and the truer 77, it is possible to adjust the surface roughness of the grinding wheel 32. For example, when the pressing force of the truer 77 against the grinding wheel 32 is adjusted to be larger, the truer 77 rotates to follow the grinding wheel 32 substantially at the same speed as the circumferential speed of the grinding wheel 32 and the circumferential speed ratio of the grinding wheel 32 and the truer 77 increases. Accordingly, it is possible to true the grinding wheel 32 to have high surface roughness. On the contrary, when the pressing force of the truer 77 against the grinding wheel 32, the degree of slipping between the grinding wheel 32 and the truer 77 increases and the circumferential speed ratio of the grinding wheel 32 and the truer 77 decreases. Accordingly, it is possible to true the grinding wheel 32 to have low surface roughness.

In Embodiment 1, when the grinding wheel 32 moves in the X direction to the truing position at which the grinding wheel 32 comes into contact with the truer 77 and the grinding wheel 32 is displaced in the Z direction to correspond to the thermal displacement of the grinding wheel shaft 31 (when the center of the concave-curved surface 77*a* of the outer circumference of the truer 77 is slightly displaced in the Z direction from the center of the grinding wheel 32), the truer 77, the truer shaft holder 75, and the Z-direction slide member 74 move in the Z axis direction along the Z-direction guide bars 73 relative to the movable table 70 so that the center of the concave-curved surface 77*a* of the outer circumference of the truer 77 matches with the center of the grinding wheel 32 while coming into contact with the grinding wheel 32 with the movement of the grinding wheel 32 to the truing position. Accordingly, even when the grinding wheel 32 is thermally displaced before starting the truing operation, it is possible to excellently true the grinding wheel 32.

Figure 7:
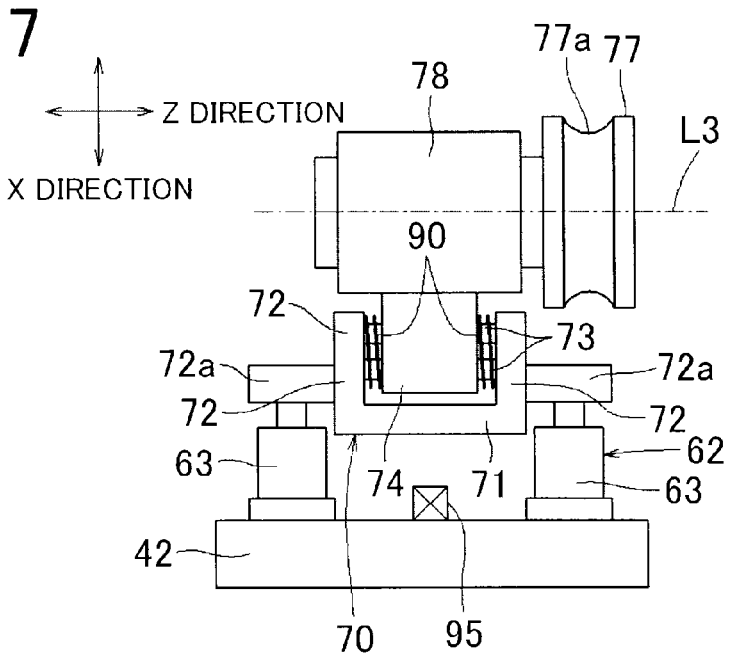
FIG. 7 is a plan view illustrating a truing unit of the grinding machine according to Embodiment 2.
Figure 8:
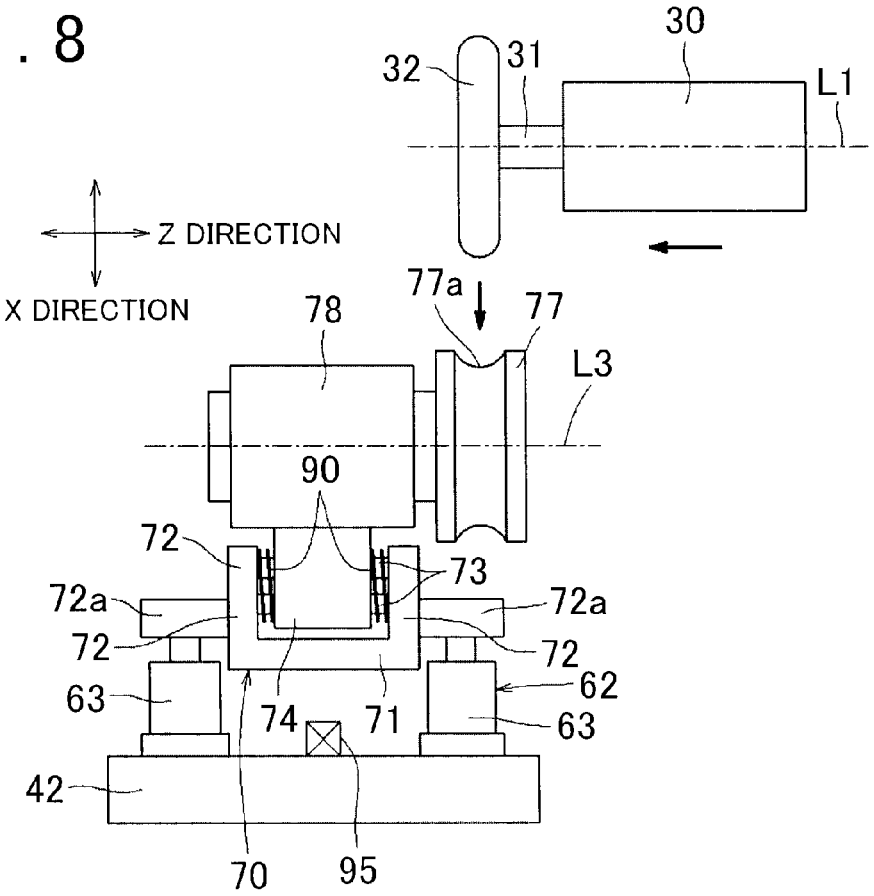
FIG. 8 is an explanatory diagram illustrating a state where the grinding wheel moves in the Z direction to a front position of the truer of the truing unit.
Figure 9:
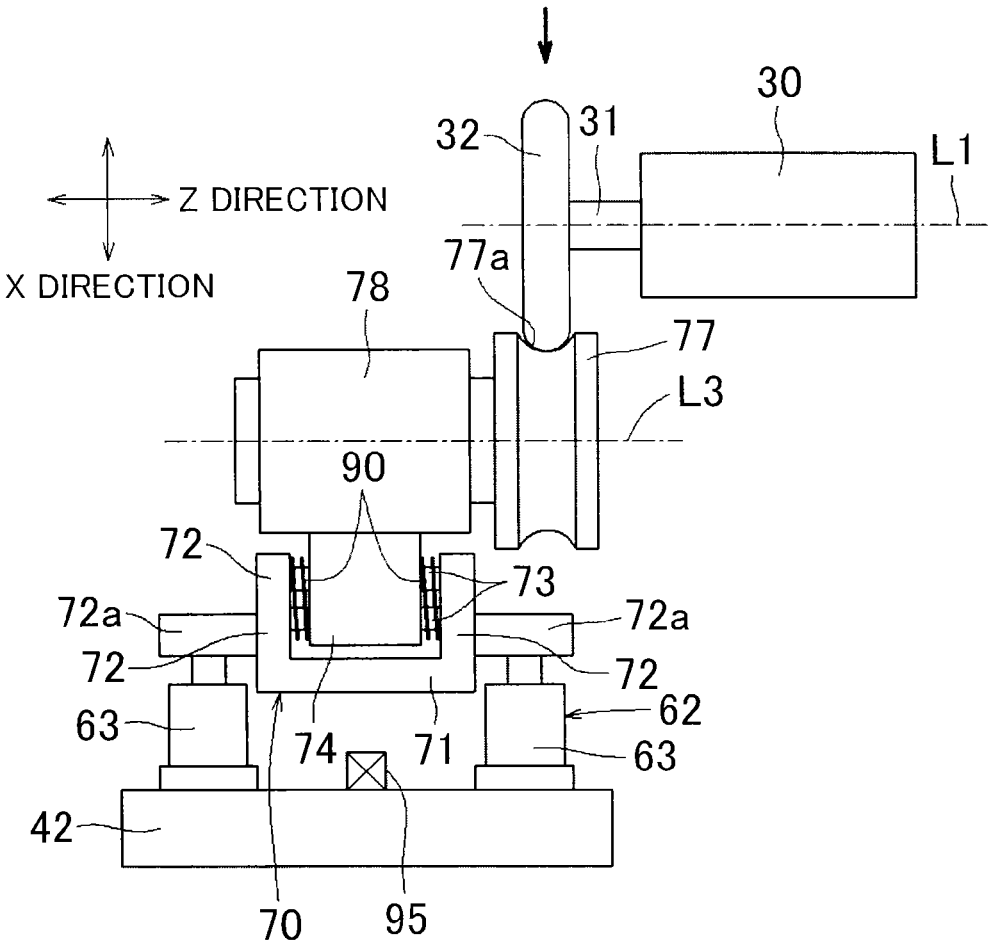
FIG. 9 is an explanatory diagram illustrating a state where the grinding wheel moves in the X direction to a truing position at which the grinding wheel comes into contact with the truer.

A grinding machine according to Embodiment 2 is the same as the grinding machine illustrated in FIGS. 1 and 2, except for the truer shaft holder 75. In Embodiment 2, a truer drive motor 78 as a drive mechanism for rotationally driving the truer 77 around the Z-direction axis line L3 is employed instead of the truer shaft holder 75. As illustrated in FIG. 7, plural (or one) Z-direction guide bars 73 are installed between both side wall portions 72 of the movable table 70, and the Z-direction guide bars 73 are provided with a Z-direction slide member 74 so as to be slidable in the Z direction in a state where the rotation thereof is stopped. Z-direction returning springs 90 are interposed between the both side wall portions 72 of the movable table 70 and the Z-direction slide member 74, and the Z-direction slide member 74 is located at the Z-direction neutral position by the Z-direction return springs 90. A truer drive motor 78 of which the operation is controlled by the controller is formed as a unified body with the Z-direction slide member 74. The output shaft of the truer drive motor 78 is provided with the truer 77 that rotates along with the outer shaft. The outer circumferential surface of an end face in the axis direction of the truer 77 is formed as a concave-curved surface (or a concave arc-like surface) 77*a*. An X-direction displacement detecting unit 95 that detects displacement in the X direction of the movable table 70 is installed between the movable table 70 and the spindle housing 42 as the support member.

Figure 10:
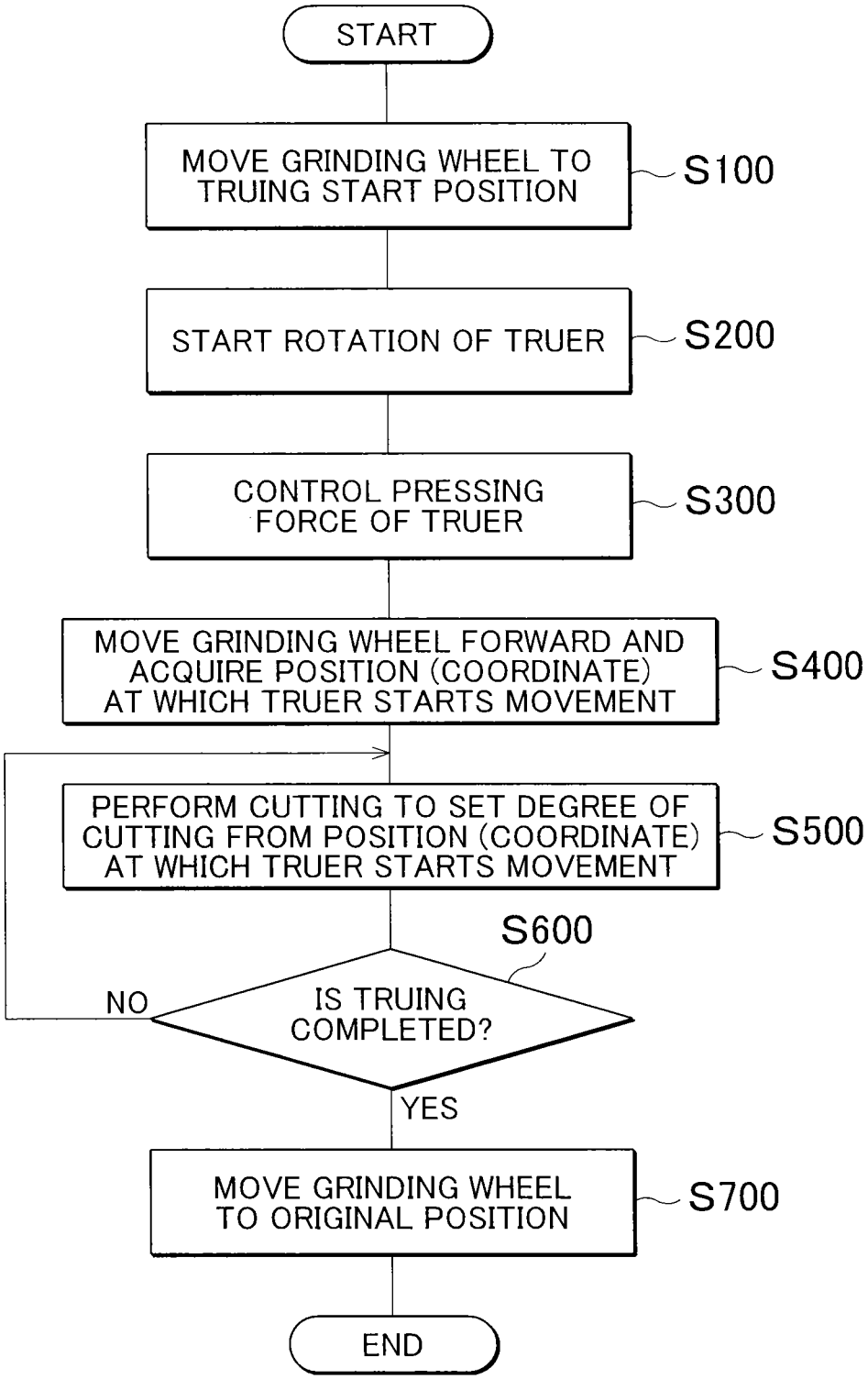
FIG. 10 is a flowchart illustrating a process flow of a truing process.
Figure 11:
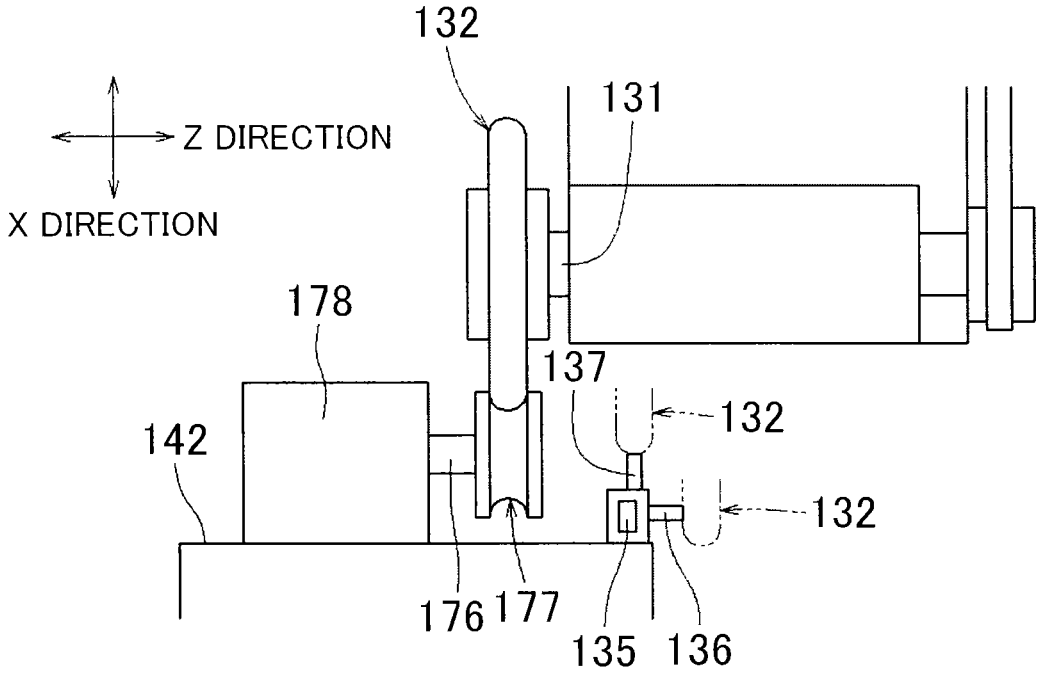
FIG. 11 is a plan view illustrating a truing unit of a grinding machine according to the related art.

An example of a process flow which is performed by the controller will be described below with reference to the flowchart illustrated in FIG. 10. The controller performs the process flow illustrated in FIG. 10 when performing of a truing operation is instructed, when a predetermined truing timing arrives, or the like. In step S100, the controller controls the operation of the Z-direction drive motor 14 and the X-direction drive motor 24 so that the position of the truer 77 relative to the grinding wheel 32 is located at a truing start position, and accordingly causes the position of the grinding wheel 32 relative to the truer 77 to move to a set position. Since the truing process is performed between machining processes, the grinding wheel 32 is in a rotating state. Then, the controller causes the truer 77 and the grinding wheel 32 to face each other and then performs the process of step S200. In step S200, the controller controls the operation of the truer drive motor 78 so as to start the rotational driving of the truer 77, and then performs the process of step S300.

In step S300, the controller controls the pressing force of the truer 77 and then performs the process of step S400. In Embodiment 2, the X-direction pressing cylinders 63 are used to control the pressing force of the truer 77. In this case, the pressure control valve for the X-direction pressing cylinders 63 is controlled to a desired pressing force so as to adjust the pressing force of the X-direction pressing cylinders 63. When the outer circumferential surface of the grinding wheel 32 is trued to a minute degree of truing (setting teeth), the pressing force is set to be relatively small. When the outer shape of the grinding wheel 32 is corrected (when the outer shape is reshaped), the pressing force is set to be relatively large.

In step S400, the controller causes the grinding wheel 32 to slowly move toward the truer 77, acquires the coordinate of the grinding wheel 32 when the truer 77 starts movement in the X direction, and then performs the process of step S500. The controller can detect the start of movement in the X direction of the truer 77 on the basis of the detection signal from the X-direction displacement detecting unit 95 disposed on the side of the truer 77, and can detect the coordinate of the grinding wheel 32 on the basis of the detection signal from the X-direction position detecting unit 25 that detects the position of the X-direction slide table 22. The position in the X direction of the truer 77 based on the detection signal from the X-direction displacement detecting unit 95 when the truer 77 starts the movement and the X coordinate of the grinding wheel 32 based on the detection signal from the X-direction position detecting unit 25 when the truer 77 starts the movement in the X direction are acquired and stored in step S400.

In step S500, the controller cuts the grinding wheel 32 to a predetermined degree of cutting from the position (coordinate) of the grinding wheel 32 when the truer 77 starts the movement in the X direction. In this case, the truing operation of causing the truer 77 to move in the X direction is performed (started) and then the process of step S600 is performed.

In step S600, the controller determines whether the truing operation is performed to a predetermined degree of cutting on the basis of the position (which is stored in step S400) in the X-direction of the truer 77 at the time of starting the truing operation (when the truer 77 starts the movement in the X direction), the current position in the X direction of the truer 77 which is detected by the X-direction displacement detecting unit 95, the coordinate (which is stored in step S400) in the X direction of the grinding wheel 32 at the time of starting the truing operation (when the truer 77 starts the movement), and the current coordinate in the X-direction of the grinding wheel 32 which is detected by the X-direction position detecting unit 25. When it is determined that the truing operation is performed to the predetermined degree of cutting (YES), the controller determines that the truing operation is completed and then performs the process of step S700. When it is determined that the truing operation is not performed to the predetermined degree of cutting (NO), the controller determines that the truing operation is not completed and then performs the process of step S500 again. In step S700, the controller causes the grinding wheel 32 to move to the original position relative to the truer 77, stops the control of the rotation driving of the truer 77 and the pressing force of the truer 77, and ends the truing process.

As described above, in Embodiment 2, when the grinding wheel 32 is trued, the truer 77 is pressed against the grinding wheel 32 with the pressing force set by the X-direction pressing cylinders 63 as the X-direction pressing mechanism 62. Accordingly, the grinding wheel 32 is excellently trued. As a result, it is possible to save the labor for detecting the outer circumferential position of the grinding wheel 32 before performing the truing operation and thus to reduce the truing time of the grinding wheel 32 by as much.

When the degree of truing of the grinding wheel 32 is small (minute), it is possible to excellently true the machining surface (grinding wheel surface) of the grinding wheel 32 by setting the pressing force of the truer 77 against the grinding wheel 32 to be smaller by the use of the X-direction pressing cylinders 63. When the degree of truing of the grinding wheel 32 is large, it is possible to true the machining surface (grinding wheel surface) of the grinding wheel 32 by setting the pressing force of the truer 77 against the grinding wheel 32 to be larger by the use of the X-direction pressing cylinders 63.

In Embodiment 2, when the grinding wheel 32 moves in the X direction to the truing position at which the grinding wheel 32 comes into contact with the truer 77 and the grinding wheel 32 is displaced in the Z direction to correspond to the thermal displacement of the grinding wheel shaft 31 (when the center of the concave-curved surface 77*a* of the outer circumference of the truer 77 is slightly displaced in the Z direction from the center of the grinding wheel 32), the truer 77, the truer drive motor 78, and the Z-direction slide member 74 move in the Z axis direction along the Z-direction guide bars 73 relative to the movable table 70 so that the center of the concave-curved surface 77*a* of the outer circumference of the truer 77 matches with the center of the grinding wheel 32 while coming into contact with the grinding wheel 32 with the movement of the grinding wheel 32 to the truing position. Accordingly, it is possible to save the labor for detecting the thermal displacement of the grinding wheel 32 before performing the truing operation and thus to reduce the truing time of the grinding wheel 32 by as much. In addition, since the truing operation is performed while the pressing force with which the truer 77 is pressed against the grinding wheel 32 is kept constant, it is possible to more uniformly true the outer circumferential surface (machining surface) of the grinding wheel 32.

In Embodiments 1 and 2, since the truer 77 is returned to the Z-direction neutral position by the Z-direction return springs 90 relative to the movable table 70, the truer 77 is not located close to one end in the Z direction. Accordingly, when the grinding wheel 32 moves in the X direction to the truing position at which the grinding wheel 32 comes into contact with the truer 77 and the grinding wheel 32 is displaced in the Z direction to correspond to the thermal displacement of the grinding wheel shaft 31, the truer 77 comes into contact with the grinding wheel 32 and is displaced (moves) in the Z direction without contact failure to follow the movement of the grinding wheel 32 to the truing position. As a result, it is possible to excellently true the machining surface (grinding wheel surface) of the grinding wheel 32 without truing failure. That is, when the truer 77 is not located at the Z-direction neutral position but is located close to one end in the Z direction, the grinding wheel 32 may depart from the concave-curved surface 77*a* of the outer circumference of the truer 77 and truing failure may occur. However, according to the embodiments, this problem can be prevented.

The present invention is not limited to Embodiments 1 and 2, but may be modified in various forms without departing from the gist of the present invention. For example, Embodiments 1 and 2 describe that the Z-direction return springs 90 are respectively interposed between the both side wall portions 72 of the movable table 70 and the Z-direction slide member 74, but the Z-direction return springs 90 may be not provided necessarily to embody the present invention.

What is claimed is:

1. A grinding machine comprising:

a grinding wheel of which movement in an X direction and a Z direction is controlled and that grinds a workpiece; and a truing unit that is installed at a predetermined position and that trues a machining surface of the grinding wheel, wherein the truing unit includes:

a movable table that is installed to be movable in the X direction relative to a support member;

a truer that is rotatably installed in the movable table and that trues the machining surface of the grinding wheel, and an X-direction pressing mechanism that presses the truer in the X direction along with the movable table, wherein the movable table is installed to be movable in the X direction relative to the support member in a state where the movable table is pressed in the X direction by the X-direction pressing mechanism, and wherein the truer is installed to be rotatable about an axis line in the Z direction relative to the movable table and trues the machining surface of the grinding wheel by coming into contact with the grinding wheel with a pressing force of the X-direction pressing mechanism and being rotated by the grinding wheel.

2. The grinding machine according to claim 1, wherein the X-direction pressing mechanism is configured to adjust the pressing force of the truer against the grinding wheel.

3. The grinding machine according to claim 1, wherein the truer is installed to be movable in the Z direction relative to the movable table.

4. A grinding machine comprising:

a grinding wheel of which movement in an X direction and a Z direction is controlled and that grinds a workpiece; and a truing unit that is installed at a predetermined position and that trues a machining surface of the grinding wheel, wherein the truing unit includes:

a movable table that is installed to be movable in the X direction relative to a support member;

a truer that is rotatably installed in the movable table and that trues the machining surface of the grinding wheel, and an X-direction pressing mechanism that presses the truer in the X direction along with the movable table, wherein the movable table is installed to be movable in the X direction relative to the support member in a state where the movable table is pressed in the X direction by the X-direction pressing mechanism, wherein the truer is installed to be rotatable about an axis line in the Z direction relative to the movable table and trues the machining surface of the grinding wheel by coming into contact with the grinding wheel with a pressing force of the X-direction pressing mechanism and rotating to follow the grinding wheel, wherein the truer is installed to be movable in the Z direction relative to the movable table, and wherein the truer is returned to a Z-direction neutral position relative to the movable table by a Z-direction return spring.

5. A grinding machine comprising:

a grinding wheel of which movement in an X direction and a Z direction is controlled and that grinds a workpiece; and a truing unit that is installed at a predetermined position and that trues a machining surface of the grinding wheel, wherein the truing unit includes:

a movable table that is installed to be movable in the X direction relative to a support member;

a truer that is rotatably installed in the movable table and that trues the machining surface of the grinding wheel, a drive mechanism that rotationally drives the truer, and an X-direction pressing mechanism that presses the truer in the X direction along with the movable table, wherein the truer is installed to be movable in the Z direction relative to the movable table.

6. The grinding machine according to claim 5, wherein the X-direction pressing mechanism is configured to adjust a pressing force of the truer against the grinding wheel.

7. The grinding machine according to claim 5, wherein the truer is returned to a Z-direction neutral position relative to the movable table by a Z-direction return spring.

8. A grinding machine comprising:

a grinding wheel of which movement in an X direction and a Z direction is controlled and that grinds a workpiece; and a truing unit that is installed at a predetermined position and that trues a machining surface of the grinding wheel, wherein the truing unit includes:

a movable table that is installed to be movable in the X direction relative to a support member;

a truer that is rotatably installed in the movable table and that trues the machining surface of the grinding wheel, and an X-direction pressing mechanism that presses the truer in the X direction along with the movable table, wherein the truer is installed to be movable in the Z direction relative to the movable table, and wherein the truer is returned to a Z-direction neutral position relative to the movable table by a Z-direction return spring.

* * * * *